US007344118B2

(12) United States Patent
Samberg

(10) Patent No.: US 7,344,118 B2
(45) Date of Patent: Mar. 18, 2008

(54) HOLDER FOR SUPPORTING A SCREWDRIVER FROM THE HANDLE THEREOF

(76) Inventor: Ian Samberg, 106 Laporte St., Montreal, Quebec (CA) H9A 3H5

( * ) Notice: Subject to any disclaimer, the term of this patent is extended or adjusted under 35 U.S.C. 154(b) by 448 days.

(21) Appl. No.: 11/006,708

(22) Filed: Dec. 8, 2004

(65) Prior Publication Data

US 2006/0118449 A1 Jun. 8, 2006

(51) Int. Cl.
*A47G 29/087* (2006.01)
*B25B 23/16* (2006.01)
*B25G 1/00* (2006.01)

(52) U.S. Cl. ..... 248/690; 81/177.1; 81/436; 81/489; 206/349; 206/477; 248/686

(58) Field of Classification Search ..... 206/349, 206/806, 493, 495, 477–480; 211/70.6; 248/309.1, 248/682–690; 81/436, 177.1, 177.5, 489–492, 81/177.2; 16/431
See application file for complete search history.

(56) References Cited

U.S. PATENT DOCUMENTS 1,439,106 A * 12/1922 Horn ..... 248/690
2,870,809 A * 1/1959 Feldman et al. ..... 81/489
3,516,585 A * 6/1970 Inwood ..... 206/349
3,807,679 A * 4/1974 Burke et al. ..... 248/690
4,586,615 A 5/1986 Quitmann
4,650,074 A * 3/1987 Vosbikian ..... 206/349
5,335,772 A * 8/1994 Chervenak et al. ..... 206/349
5,956,799 A * 9/1999 Panaccione et al. ..... 81/177.1
6,094,781 A * 8/2000 Jansson et al. ..... 16/431
6,186,323 B1 * 2/2001 Jansson et al. ..... 206/349
6,425,482 B1 7/2002 Chiang
6,637,591 B2 10/2003 Chen
6,837,373 B2 * 1/2005 Huang ..... 206/806
6,935,516 B2 * 8/2005 Chiang ..... 206/349
7,070,049 B2 * 7/2006 Lee et al. ..... 206/349
7,093,524 B2 * 8/2006 Hsieh ..... 81/436

* cited by examiner

*Primary Examiner*—Bryon P Gehman
(74) *Attorney, Agent, or Firm*—Guy J. Houle; Ogilvy Renault LLP

(57) ABSTRACT

A holder in combination with a screwdriver provided with a through bore in the handle thereof for attachment by the holder. The holder has a support member provided with an aperture in an upper portion thereof. A pair of support arms depend in spaced-apart relationship from a lower portion of the support member. A detachable lock pin is detachably secured across the pair of support arms and extends through the through bore for support engagement with the screwdriver.

7 Claims, 1 Drawing Sheet

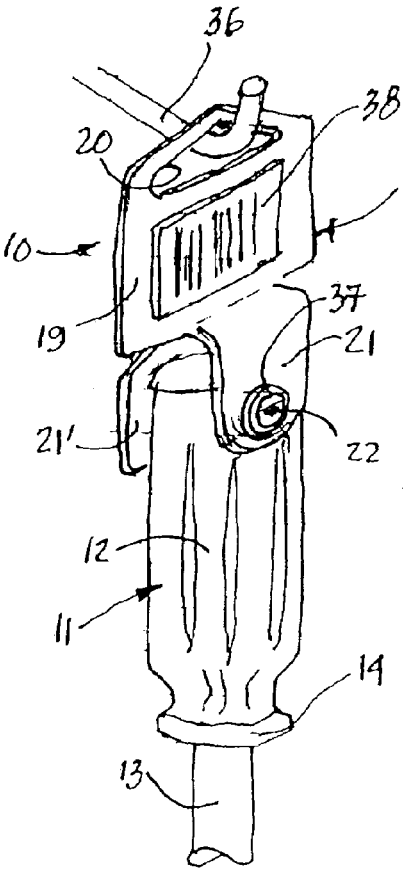
FIG. 1
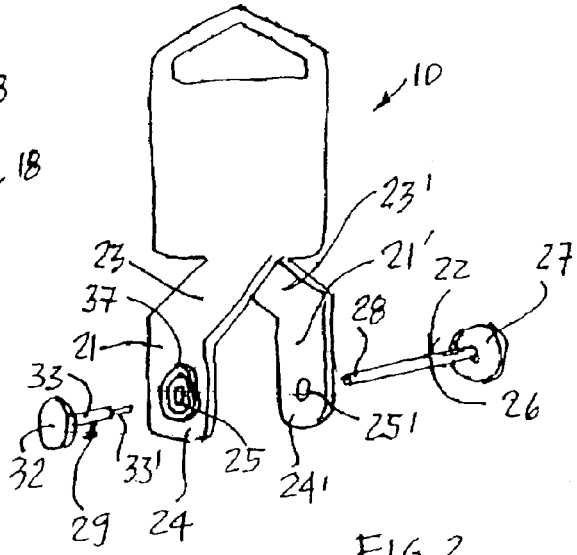
FIG. 2
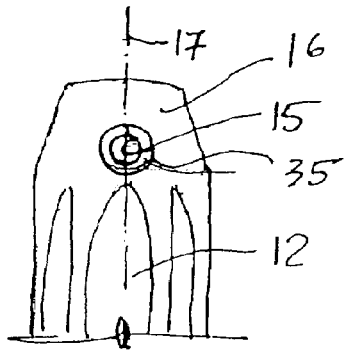
FIG. 3
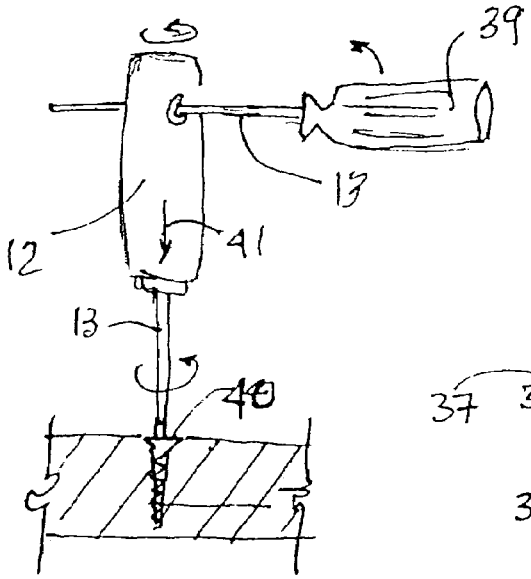
FIG. 4
FIG. 5
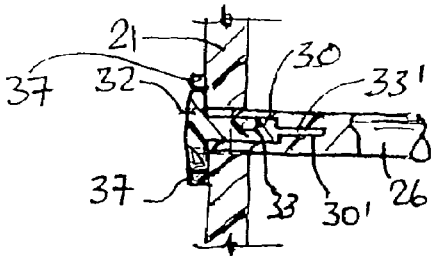

HOLDER FOR SUPPORTING A SCREWDRIVER FROM THE HANDLE THEREOF

TECHNICAL FIELD

The present invention relates to a holder and more specifically a screwdriver holder for supporting the screwdriver by a through bore provided in an upper part of the screwdriver handle.

BACKGROUND ART

Various display support holders are known for supporting screwdrivers on pegs and as an example of these reference is made to U.S. Pat. Nos. 4,586,615, 6,425,482 and 6,637,591. As thereinshown, these holders provide support of the screwdriver by the shank or by the handle and the shank and accordingly they are provided with various attachments which increases the cost of manufacture and assembly. With some of these holders, the screwdriver can be accidentally detached or easy to remove therefrom.

SUMMARY OF INVENTION

It is a feature of the present invention to provide a holder for a screwdriver or other similar article having a handle, such as chisels, files, etc. and wherein the article is supported by a through bore provided in an upper portion of the handle.

Another feature of the present invention is to provide a screwdriver having a through bore in an upper portion of the handle for support engagement with a holder and further providing for the passage of a shank of another screwdriver to provide added torque to the handle of the screwdriver.

According to the above features, from a broad aspect, the present invention provides a holder for supporting an article from a handle thereof. The holder comprises a support member having an aperture in an upper portion thereof. A pair of support arms depend in spaced-apart relationship from a lower portion of the support member. A detachable lock pin is detachably secured across the pair of support arms for support engagement with a through bore in the handle.

According to another broad aspect of the present invention the article is a screwdriver which is provided with a through bore in an upper part of the handle to provide for the passage of a shank of another screwdriver to add torque to the handle of the screwdriver, when in use.

BRIEF DESCRIPTION OF DRAWINGS

A preferred embodiment of the present invention will now be described with reference to the accompanying drawings in which:

FIG. 1 is a perspective view showing the holder of the present invention with the handle of an article such as a screwdriver, chisel, or the like, being supported thereby;

FIG. 2 is a further perspective view of the holder showing the detachable lock pin in an exploded view;

FIG. 3 is a fragmented plan view of an upper part of the handle of an article supported by the holder showing the through bore provided therein;

FIG. 4 is a perspective view showing the added utility of the through bore wherein torque may be applied to the handle by the shank of another screwdriver disposed within the through bore; and FIG. 5 is an enlarged fragmented partly sectioned view showing the construction of the detachable lock pin.

DESCRIPTION OF PREFERRED EMBODIMENTS

Referring now to the drawings and more particularly to FIGS. 1 to 3, there is shown generally at 10 the holder of the present invention for supporting an article 11 from a handle 12 thereof. The article as hereinshown is a screwdriver, a chisel, or the like articles having a shank 13 depending from a lower portion 14 of the handle.

As shown in FIG. 3, the handle 12 of the article is provided with a through bore 15 extending from an upper portion 16 of the handle 12. The through bore also extends transversely of the longitudinal axis 17 of the handle and therefore passes at the center of the handle.

As illustrated in FIGS. 1 and 2, the holder comprises a support member 18 which is a one-piece plastic injection molded member and defines an integrally formed flat plate portion 19 provided with an aperture 20 in an upper part thereof. A pair of support arms 21 and 21' depend in spaced-apart relationship from a lower portion of the support plate portion 19. A detachable lock pin 22 is detachably secured across the support arms 21 and 21' and extends through the through bore 15 for support engagement therewith in order to support the article 11 depending from the support arms of the support member.

As shown in FIG. 2, the support arms 21 and 21' have an outwardly extending and downwardly sloped upper portions 23 and 23', respectively, and downwardly extending lower parallel portions 24 and 24', respectively. The downwardly extending portions are spaced apart a distance sufficient to receive the upper portion of the screwdriver handle 12 therebetween. The support arms 21 and 21' are further provided with holes 25 and 25', respectively, which are transversely aligned with one another to receive the lock pin 22 therethrough.

With added reference to FIG. 5, there will now be described the construction of the lock pin 22. As hereinshown the lock pin has a pin portion with an elongated pin 26 provided with a head 27 at one end thereof. The head is larger than the holes 25 and 25'. The pin 26 has an end connector 28 at a free end thereof permitting passage of the free end and the pin through the holes 25 and 25'. The end connector 28 is engageable with a complimentary head connector 29. The pin connector, as better shown in FIG. 5, is constituted by an axial bore 30 in an end face 31 of the lock pin. The head connector 29 is also provided with a head portion 32 and an integrally formed pin portion 33. The pin portion 33 is dimensioned for close friction fit in the axial bore 30 of the pin 26. The pin portion 33 may also have an end projection 33' for added friction fit in a smaller diameter end section 30' of the axial bore 30. Accordingly, the lock pin is in secured engagement between the support arms 21 and 21'. To facilitate disengagement of the lock pin, the support arms can easily be wedged apart from the bottom end thereof to provide an outward force against the heads 27 and 32 of the lock pin to pull the pin portion 33 out of the axial bore 30.

In order to reinforce the through bore 16, and as shown in FIG. 3, the through bore is provided with a rigid plastic sleeve 35 which is molded in the handle 12 and formed integral therewith by an injection molding process. The handle 12 is also injection molded onto the shank 13.

In order to deter theft or ease of removal of the lock pin 22 from the support arms 21 when the article is displayed on a hanger pin, such as that shown at 36 in FIG. 1, the support arms 21 and 21' are also formed with a circular ridge 37 integrally molded about the through bores 25 and 25' and concentrically spaced thereabout on an outer face of the support arms, as shown in FIG. 2. The head 27 and head portion 32 of the lock pin 22 are flat disc shaped heads and are dimensioned to be received within the circular ridges 37 to protect the circumferential edge of the pin to prevent engagement from under the circular heads thereof. By pressing the support arms towards one another, the heads 27 and 32 extend out of the circular ridges.

As previously described, the support arms 21 and 21' are molded of plastics material and integrally formed with the support member 18 and this permits the arms to flex towards or away from one another to facilitate engagement and removal of the lock pin with the handle 12 of the article. The flat plastic plate portion 19 also permits the attachment of labels such as the barcode label 38, as shown in FIG. 1, or other display labels or security labels. The aperture 20 may also have various configurations for support engagement with suitable support members.

An added feature of the through bore 15 as provided in the upper part of the handle 12 of a screwdriver article is to permit torqueing of the screwdriver. Accordingly, the through bore 15 is dimensioned for receiving the shank 13 of another screwdriver 39, such as shown in FIG. 4, through the through bore 15 to provide torqueing of the handle such as for the removal of screws 40 rigidly embedded in a surface. By applying downward pressure of the engaged screwdriver in the direction of arrow 41 and by torqueing the handle 12 by the use of the further screwdriver added torque is provided in the shank 13 of the engaged screwdriver thereby facilitating the removal of such screws. The through bore extends transversely through the handle and through the central longitudinal axis 17 of the handle 12.

It is also within the ambit of the present invention to cover any obvious modifications of the preferred embodiment described herein, provided such modifications fall within the scope of the appended claims.

The invention claimed is:

1. A one-piece, plastic injected, holder in combination with a screwdriver having a through bore provided in a top portion of a handle of the screwdriver, said holder comprising a support member having an aperture in an upper portion thereof, a pair of support arms formed integrated with said support member and depending in spaced-apart relationship from a lower portion of said support member, said support arms each having a hole therein, said holes being transversely aligned with one another, a detachable lock pin detachably secured across said pair of support arms and extending through said holes and through said through bore in the handle of the screwdriver whereby said screwdriver depends from under said support member, said lock pin having a head at one end thereof, said head being larger than said holes, and an end connector at a free end thereof permitting passage of said free end through said holes, said end connector being engageable with a complementary head connector, said end connector being constituted by an axial bore in an end face of said lock pin at said opposed end, said head connector having a head portion of an internally formed pin portion, said pin portion being dimensioned for close friction fit in said axial bore, said support arms being flat flexible support arms permitting them to flex towards or away form one another to facilitate engagement and removal of said lock pin with the handle of the screwdriver said support arms are each provided with a circular ridge integrally formed about said hole on an outer face of said support arms, said head portion of said pin portion being a flat disc shaped head dimensioned to be received within said circular ridge for protection thereof.

2. A holder as claimed in claim 1 wherein said through bore in said handle of said screwdriver is provided with a rigid plastic sleeve.

3. A holder as claimed in claim 2 wherein said rigid plastic sleeve is molded in said handle and formed integral therewith, said handle being injection molded on a shank of said screwdriver.

4. A holder as claimed in claim 1 wherein said support member has an integrally formed flat plate portion.

5. A holder as claimed in claim 4 wherein said flat plate portion has a rectangular section for receiving labels thereon.

6. A holder as claimed in claim 1 wherein said aperture is configured for receiving a pin support element therethrough.

7. A holder as claimed in claim 1 wherein said through bore in an upper part of said handle is dimensioned to receive a shank of another screwdriver therethrough to provide added torque force to said handle.

* * * * *